United States Patent [19]

Dal Pan et al.

[11] Patent Number: 4,503,698

[45] Date of Patent: Mar. 12, 1985

[54] APPARATUS FOR SUPPORTING THE PIERCING MANDREL BACK-UP BAR OF A PRESS-PIERCING ROLLING MILL

[75] Inventors: Giacinto Dal Pan, Brescia; Edgardo Gnecchi, Sesto S. Giovanni, both of Italy

[73] Assignee: Innse Innocente Santeustacchio S.p.A., Brescia, Italy

[21] Appl. No.: 497,555

[22] Filed: May 24, 1983

[30] Foreign Application Priority Data

May 28, 1982 [IT] Italy ..... 21547 A/82

[51] Int. Cl.[3] ..... B21B 17/08

[52] U.S. Cl. ..... 72/209; 72/97

[58] Field of Search ..... 72/208, 209, 96, 97, 72/405

[56] References Cited

U.S. PATENT DOCUMENTS 3,625,044 12/1971 Iann et al. ..... 72/209

4,373,370 2/1983 Allen et al. ..... 72/405

*Primary Examiner*—Lowell A. Larson

*Assistant Examiner*—Jorji M. Griffin

*Attorney, Agent, or Firm*—Hedman, Gibson, Costigan & Hoare

[57] ABSTRACT

Apparatus is provided for supporting the mandrel back-up bar of a press-piercing rolling mill. The apparatus comprises a plurality of constraining elements supported by a base in two lines disposed parallel to and symmetrically with respect to the rolling and piercing axis of the rolling mill. All the constraining elements of each line are mounted on a single beam which is supported on horizontal guides perpendicular to the rolling axis and adjustable in position on the guides. This arrangement facilitates the simultaneous adjustment of all the constraining elements making up a line.

1 Claim, 5 Drawing Figures

APPARATUS FOR SUPPORTING THE PIERCING MANDREL BACK-UP BAR OF A PRESS-PIERCING ROLLING MILL

FIELD OF THE INVENTION

The present invention relates to apparatus for supporting the mandrel back-up bar of a press-piercing rolling mill, the apparatus comprising a base located at the exit end of the press-piercing mill, and a plurality of pairs of constraining elements which are supported by the base in positions symmetrically arranged relative to the rolling and piercing axis of the mill, and are disposed in two lines parallel to this axis.

BACKGROUND OF THE INVENTION

A press-piercing rolling mill is a machine which can convert a square billet into an axially pierced, round intermediate blank. Such a machine basically comprises a rolling stand with two driven working rolls defining a circular gorge, a piercing mandrel carried at the end of a mandrel back-up bar which extends along the rolling and piercing axis from the exit side of the stand, and a pusher for thrusting a square billet between the rolls and against the piercing mandrel.

A basic condition for making round intermediate blanks which are pierced as exactly as possible along their longitudinal axis is that during the operation of the rolling mill, the mandrel back-up bar is firmly held on the rolling and piercing axis. For this purpose a plurality of pairs of constraining elements is used, these being supported in positions which are symmetrical relative to the rolling and piercing axis and being disposed in two lines parallel to this axis. During operation, each pair of constraining elements is maintained in engagement with the mandrel back-up bar, for example, by respective hydraulic cylinders. When during the course of the rolling operation, the pierced blank in its advancement along the mandrel back-up bar reaches the positions therealong where the latter is engaged by the pairs of constraining elements, these elements are operated to move them away from the bar so as not to obstruct the further advance of the blank.

For this purpose each constraining element is basically constituted by a vertical axis roller supported at one end of an arm the other end of which is rotatably mounted on a vertical pin carried by a slide. A hydraulic cylinder or similar actuator provides for the angular displacement of the arm about the corresponding vertical pin so as to position the roller in contact with the mandrel back-up bar or to space it therefrom.

The slide is movable on horizontal guides extending perpendicular to the rolling and piercing axis and its position is adjustable on these guides. In this manner, each pair of constraining elements may be adjustably positioned relative to the rolling and piercing axis to accommodate mandrel back-up bars of different transverse dimensions. Hydraulic or mechanical actuators are usually used to displace all the slides on their respective guides, these guides being mounted on the same base as that which supports the mandrel back-up bar and the bar thrust block carriage.

The inevitable existence of play in the couplings between each slide and its respective guide, and in the pivots coupling the arms to their corresponding slides and hydraulic actuators, results in the inexact positioning of the constraining elements relative to the rolling axis and, hence, a greater or lesser degree of eccentricity of the mandrel back-up bar relative to the rolling axis. As a result, the round intermediate blank produced has a piercing with even greater eccentricity and, in extreme cases, must be discarded.

To this technical disadvantage is then added the time taken by qualified personnel in suitable adjustment of the pairs of constraining elements.

SUMMARY OF THE INVENTION

The technical problem which underlies the present invention is that of overcoming these disadvantages, a problem which is resolved by the fact that all the constraining elements of each line are mounted on a single slide which is movable on respective horizontal guides carried by the base and extending perpendicular to the rolling axis, actuator members being provided for displacing the slide on its associated guides.

According to a second characteristic of the invention, each of the two slides is constituted by a beam extending parallel to the rolling axis and supported and guided on respective horizontal guides which in their turn are carried by the base on the exit side of the rolling stand.

BRIEF DESCRIPTION OF THE DRAWINGS

Further characteristics and advantages of the invention will become clearer from the description given below of one embodiment of apparatus according to the invention, reference being made to the appended drawings, given purely by way of non-limiting example, in which:

With reference to FIG. 1, a stand of a press-piercing rolling mill is schematically shown as 1, the rear pillars which constitute the exit side of the stand being indicated 2, 3 while the front pillars which constitute the entry side of the stand are indicated 4, 5.

Figure 1:
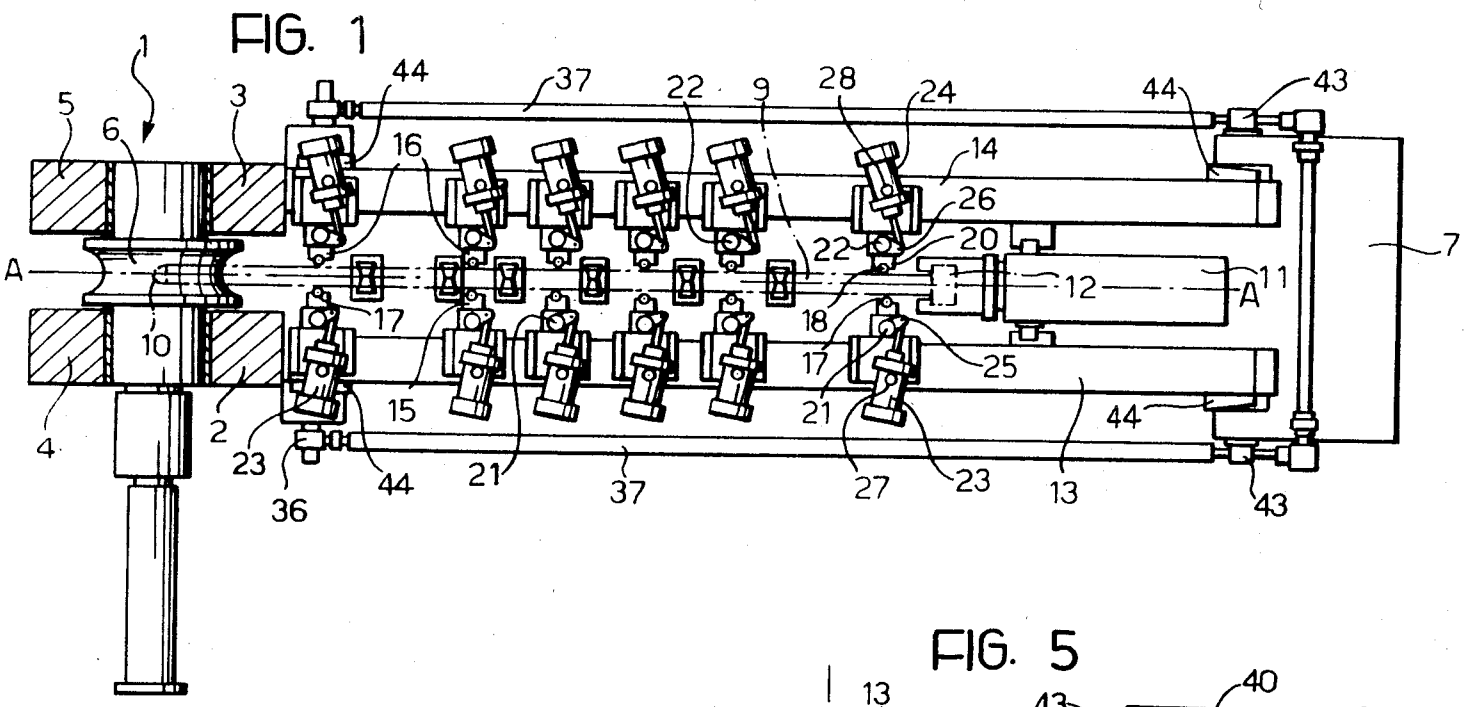
FIG. 1 is a schematic plan view from above of apparatus for supporting a mandrel back-up bar of a press-piercing rolling mill according to the invention.

The stand 1 holds two working rolls defining a circular gorge, the lower roll being indicated 6. The rolling and piercing axis of the mill is indicated A.

A base 7 is located at a predetermined distance from the exit side of the rolling stand. A bar thrust-block carriage 11 is movably guided on the base 7 in a manner known per se and not shown, the carriage 11 being of conventional structure and arranged to grip firmly and retain a terminal head 12 formed or otherwise provided on one end of a bar 9 the other end of which is formed or otherwise provided with a piercing mandrel 10. The mandrel back-up bar 9 extends along the rolling and piercing axis A and is supported in the manner described below.

The base 7 and the pillars 2, 3 of the exit side of the mill support two identical beams 13, 14 disposed parallel to and symmetrically about the axis A, in the manner described below.

On each of the beams is mounted a plurality of constraining elements, respectively indicated 15, 16, disposed in facing positions so as to constitute a plurality of pairs of constraining elements (15-16), arranged to retain the mandrel back-up bar during operation of the press-piercing mill.

Each of the constraining elements 15 (16) comprises a roller 17 (18) with its axis vertical, supported for free rotation at one end of a respective arm 19 (20), the other end of which is connected to a vertical axis pin 21 (22). This pin 21 (22) is rotatably supported in a conventional manner by the corresponding beam 13 (14) and is rotatable by a hydraulic cylinder 23 (24), through a lever 25 (26).

The cylinder 23 (24) is also mounted on the beam 13 (14) and more particularly is rotatably mounted on a vertical pin 27 (28) carried by the beam. Through the action of the cylinder 23 (24), the roller 17 (18) of the constraining element 15 (16) may be brought into an operative position in contact with the mandrel back-up bar 9 or into a non-operative position spaced from the bar by a distance such as to allow the passage of the round intermediate blank as it is produced.

The beams 13, 14 are identically supported by the base 7 and by the pillars 2, 3 at the exit side of the rolling stand and are adjustable in position relative to the rolling axis A.

By way of simplification, a preferred embodiment of such a support arrangement will be described below with reference solely to the beam 13.

Fixed to the pillar 2 is a bracket 31 constituted by a piece of square box section beam of suitable dimensions, this piece projecting towards the rolling and piercing axis A. A horizontal groove 33 is formed in the pillar 2 above the bracket 31, this groove being of rectangular transverse section and being engaged by a tongue portion 32*a* of a block 32. The block 32 can be located in various positions in the groove 33 and is firmly locked in the chosen position by a plurality of screws 34.

As a result, between the upper face of the bracket 31 and the lower face of the block 32 there is formed a horizontal guide 29 perpendicular to the rolling and piercing axis A and in which is engaged an end portion of the beam 13.

In correspondence with the guide 29, the pillar 2 and the bracket 31 support a further bracket generally indicated 35 disposed laterally of the beam 13. A jack 36 is located and fixed on this bracket 35, the jack being operated by a control 37 and in its turn operating a horizontal pusher rod 38 extending perpendicular to the axis A. The free end of the rod 38 is formed as a plate 38*a* and is connected to the side wall of the beam 13.

Figure 5:
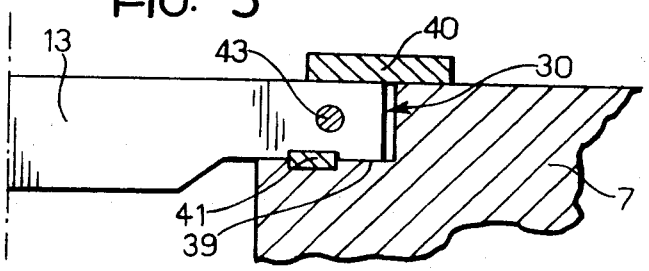
FIG. 5 shows an enlarged cross sectional side view of the apparatus from the longitudinally opposite end of the beam shown in FIGS. 2–4.
Figure 2:
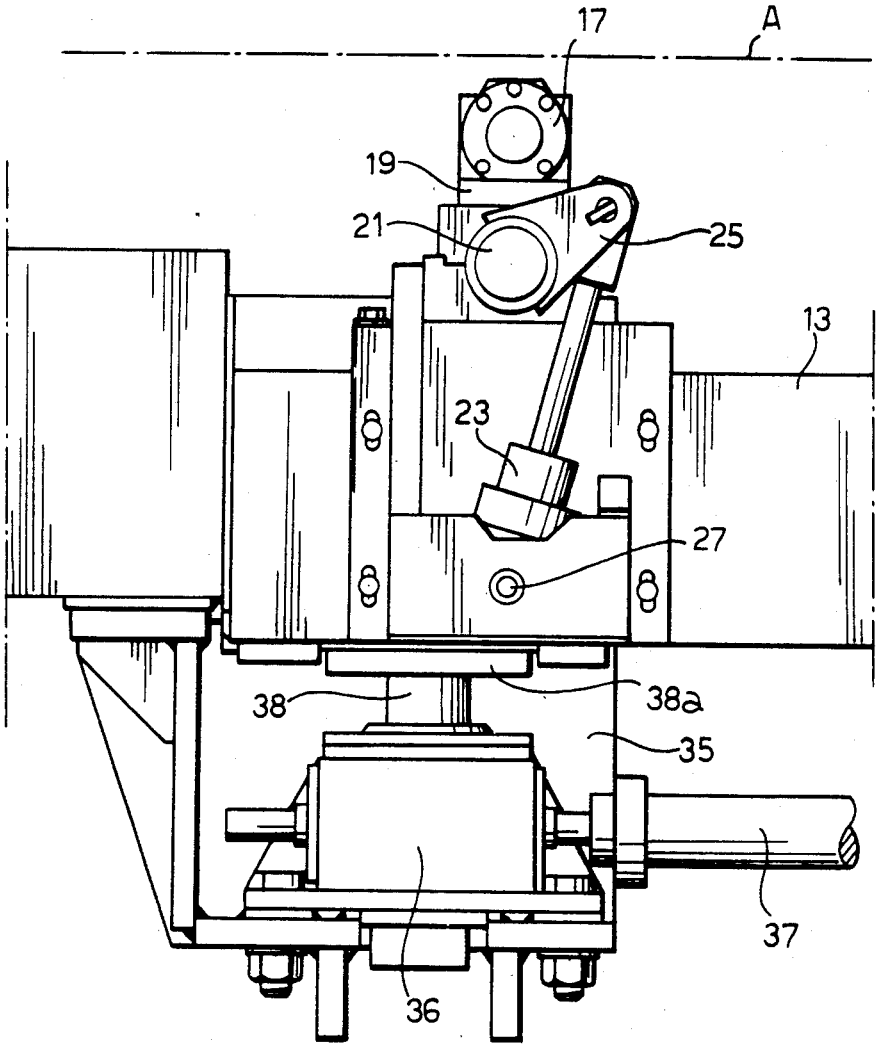
FIG. 2 is a view of a detail of the apparatus of FIG. 1 from above and on an enlarged scale.
Figure 3:
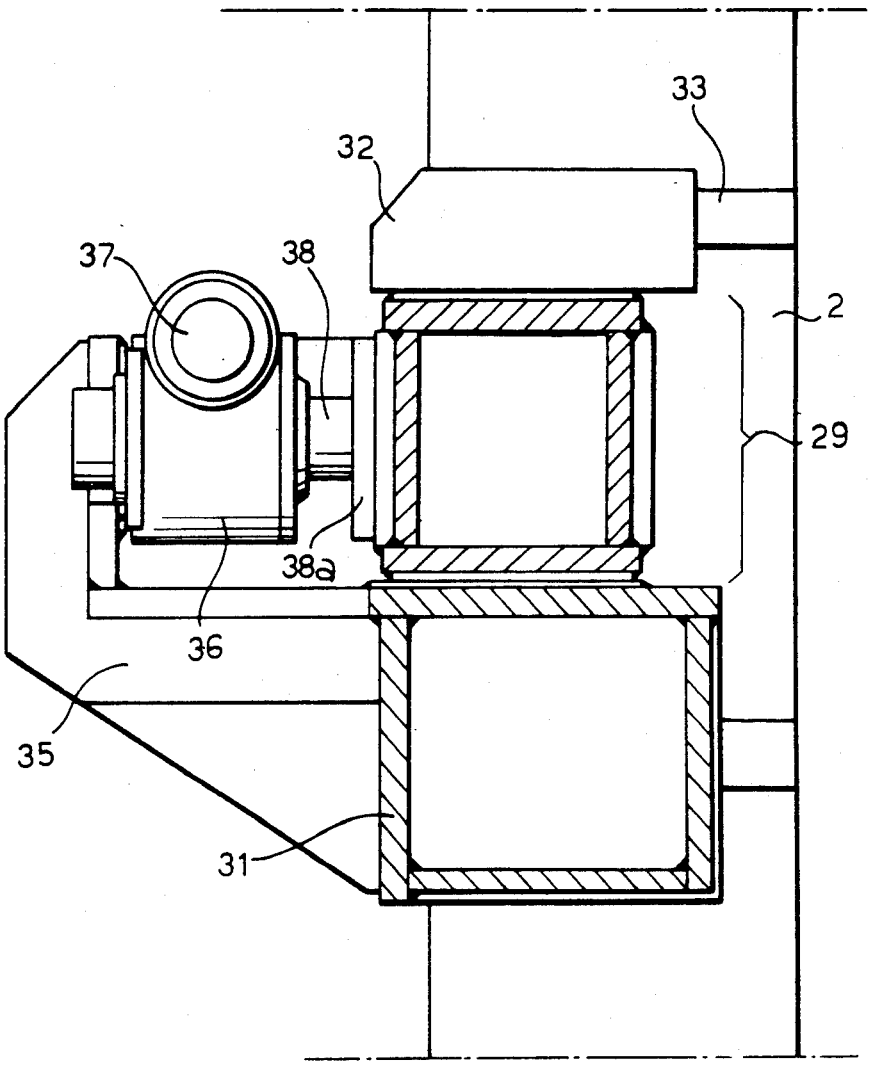
FIG. 3 is a transverse section of the detail of FIG. 2.
Figure 4:
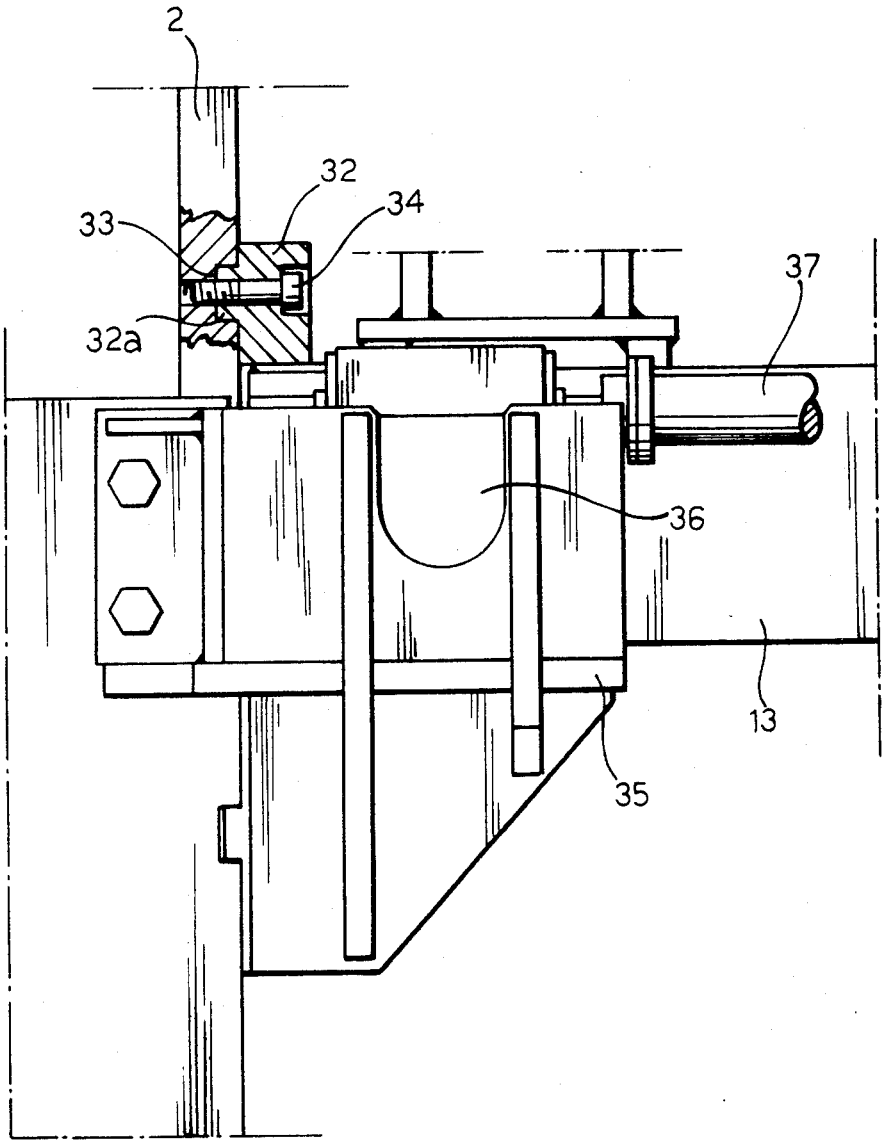
FIG. 4 is a side view of the same enlarged detail as in FIG. 2.

With reference to FIG. 5, the upper side of that part of the base 7 at the exist of the rolling mill is formed with a rebate 39 which, in cooperation with a plate 40 fixed to the upper side of the base by known means not shown, forms a guide 30 which is horizontal and perpendicular to the rolling and piercing axis A. An end portion of the beam 13 is engaged in this guide 30.

A key 41 or other similar device prevents axial displacement of the beam 13 when located in the guides 29, 30 described above.

Associated with this guide 30 is also a jack 42 operated by the same control 37 as works the jack 36. The rod 43 of this jack acts on the portion of the beam 13 engaged in the guide 30, and is coupled thereto in a conventional manner.

When the beams 13 and 14 are located relative to the rolling and piercing axis A exactly as required by the transverse dimensions of the mandrel back-up bar 9, the beams are firmly locked, by means of wedges shown schematically as 44 or other similar conventional locking devices, against fixed locating members, not shown, respectively formed in the base 7 and in the pillars 2, 3 on the exit side of the rolling stand.

The main advantage of the apparatus of this invention is constituted by the fact that all the constraining elements used in the apparatus itself for supporting the mandrel back-up bar can be located simultaneously by setting the positions of the beam 13, 14. Consequently the disadvantages of the play existing between the various constraining element slide-actuator couplings of the known art are avoided.

A further advantage is constituted by the fact that the beams 13, 14 having been locked in their respective guides 29, 30 (for example by means of the wedges mentioned above), the beams form a closed framework with the base 7 and the pillars 2, 3 at the exit side of the rolling stand which is particularly resistant to the considerable forces arising during operation of the press-piercing mill.

Not the least advantage is the considerable structural simplication presented by the apparatus of this invention compared with those of the known art. Indeed, all the slides and their support guides, all the members for moving the slides and for locking them in the desired positions are eliminated.

We claim:

1. In a press-piercing rolling mill comprising a rolling stand defining a rolling and piercing axis, a piercing mandrel, and a mandrel back-up bar carrying the piercing mandrel and extending along said axis on the exit side of the rolling stand, apparatus for supporting and increasing the rigidity of the mandrel back-up bar, comprising:

a base disposed on the exit side of the rolling stand, first and second lines of constraining elements extending symmetrically with respect to and parallel with the said rolling and piercing axis, two beams respectively mounting all the constraining elements of the first line and of the second line of constraining elements, said beams extending symmetrically with respect to, and parallel with, said axis, a respective pair of horizontal guides supporting each said beam at its end, wherein said beams are adjustable in said guides relative to the rolling axis, each of said guides extending perpendicular to the said axis and being rigidly fixed respectively to the exit side of the said rolling stand and to the said base, and securing means for securing the beams rigidly in predetermined positions on their said guides relative to the said axis whereby to form a closed frame constituted by the beams, the exit side of the rolling stand and the said base.

* * * * *